United States Patent [19]

Ienna-Balistreri

[11] 4,345,242

[45] Aug. 17, 1982

[54] GAS DETECTOR

[76] Inventor: Angelo Ienna-Balistreri, 1875 W. Sheridan Ave., Milwaukee, Wis. 53209

[21] Appl. No.: 236,528

[22] Filed: Feb. 20, 1981

[51] Int. Cl.[3] ..... G08B 17/10

[52] U.S. Cl. ..... 340/634; 340/693; 422/98

[58] Field of Search ..... 340/634, 633, 632, 693; 422/98; 73/23

[56] References Cited

U.S. PATENT DOCUMENTS 3,801,972 4/1974 Ho Kim et al. ..... 340/633 X 3,860,919 1/1975 Aker ..... 340/634 X

*Primary Examiner*—John W. Caldwell, Sr.

*Assistant Examiner*—Daniel Myer

*Attorney, Agent, or Firm*—Andrus, Sceales, Starke & Sawall

[57] ABSTRACT

A gas detector (11) provides a comparator (22) having a plurality of inputs to provide a simplistic but yet reliable sensing sequence for detecting a contaminated gas such as carbon monoxide. A first input (55) is supplied from an enable circuit (41) which disables the comparator (22) for a predetermined period of time to prevent operation of an associated alarm (33) to permit a heater (14) of a gas sensor (12) to be initially energized to properly condition the associated gas sensing electrodes (13). A second input (16) is supplied from the gas sensor (12) to continually monitor the carbon monoxide concentration to provide an alarm (33) when sensing a high level of gas contamination. A third input (34) provides a latching circuit to continually activate the alarm (33) until the power input (15) is de-energized. A fourth input (27) provides a predetermined reference voltage to the comparator (22). A second comparator (35) senses a low or intermediate level of gas concentration to energize a second signal (39) and is likewise disabled by the enable circuit (41) for a predetermined time while the sensor (12) is being initially conditioned for operation.

6 Claims, 1 Drawing Figure

GAS DETECTOR

BACKGROUND OF THE INVENTION

The invention relates to a gas detector and particularly to a simplified but reliable construction for use with a conventional gas sensor of the electrically heated semi-conductive type whose resistance varies as a function of a sensed contaminating gas.

One type of commercially available gas sensor employs a semi-conductor element providing a suitably doped metal oxide to sense the concentration of a contaminated gas, such as carbon monoxide, and is designed to be heated via a heating element to a certain temperature to achieve stability for maximum sensitivity, such as a Taguchi type sensor marketed under the trade designation TGS#812 by Figaro Engineering, Inc. of Osaka, Japan.

BRIEF SUMMARY OF INVENTION

A gas detector is particularly designed to sense a contaminated gas such as carbon monoxide and provides a plurality of inputs to a single comparator circuit to provide a multiplicity of functions in a simplified but reliable circuit construction.

An electrical power circuit is selectively energized to initiate detector operation. A commercially available gas sensor of the type which includes a sensing portion and a heater having an input connected to the power circuit to provide heat to the sensing portion is positioned to be exposed to the surrounding environment to detect concentrations of the contaminating gas. The comparator provides an output which is selectively transferrable between a first condition to indicate a gas concentration below a predetermined magnitude and a second condition to activate an alarm to indicate a gas concentration above the predetermined magnitude. The plurality of inputs provided to the comparator include a first input which is connected to an enable circuit which, in turn, is connected to the power input to provide a timed output responsive to a predetermined time delay following initial energization of the power circuit. Such first comparator input from the enable circuit disables the comparator for the predetermined time delay to prevent operation of the alarm while the heater is initially being energized to prevent an erroneous alarm during the initial warm-up period for the gas sensor. A second input to the comparator is supplied from the gas detector to continuously monitor the carbon monoxide concentration to provide the second output condition in response to a sensing of the predetermined magnitude of gas concentration. A third input to the comparator is supplied from the comparator output to latch the comparator to continuously activate the alarm in response to the occurrence of the second output condition. A resetting sequence is provided by selectively de-energizing the electrical power circuit to de-activate the alarm to thereby condition the gas detector for another sequence of continued gas monitoring.

The gas detector is particularly desirable because it is designed to be removably connected to a vehicle electrical system. The gas detector may therefore include a removable connector which is readily connected to a vehicle electrical source, such as by insertion into a conventional cigarette lighter receptacle frequently found in automobiles, airplanes, boats and the like.

The gas detector also provides a dual contamination level warning by using a second comparator which is connected to the gas sensor to activate a light when sensing a lower or intermediate level of contaminated gas while the first comparator activates an audio type of alarm in response to the sensing of a higher level of contaminated gas. Both of the first and second comparators have inputs connected to the enable circuit to disable both of the comparators for the predetermined time delay.

A highly reliable enable circuit includes a timing circuit connected with third and fourth comparators to provide a timed disable of the first and second comparators while also operating a signal to provide a visual display indicative of the disable sequence.

The gas detector provides numerous advantageous circuit constructions. For example, an additional fourth input is provided to the first comparator so that a single comparator responds to four inputs to provide an extremely reliable but yet simplified construction. A single voltage divider provides a plurality of predetermined magnitude reference voltages for use in the comparator circuits. The resetting sequence also includes a resetting circuit which connects a capacitor in the enable circuit to the voltage divider circuit to de-energize the capacitor in response to the de-energization of the power input.

The gas detector is a portable device which may be mass produced at low cost to permit wide spread use by the general public for life saving applications.

Further aspects of the invention are disclosed in the claims, drawings and specification as hereinafter provided.

DESCRIPTION OF THE PREFERRED EMBODIMENT

Figure 1:
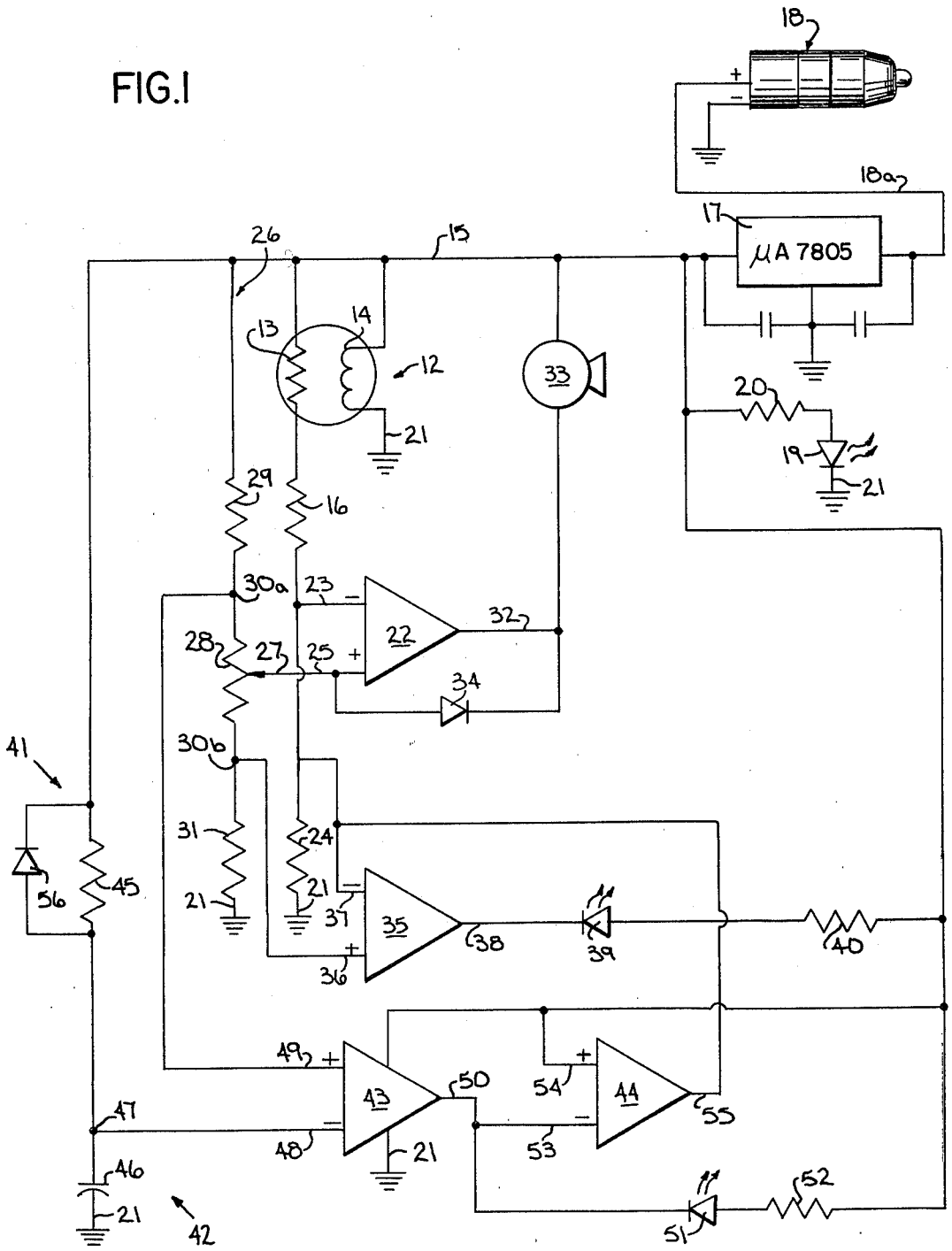
FIG. 1 of the drawing is an electrical circuit schematic disclosing the gas detector of the invention.

A gas detector 11 includes a gas sensor 12 of the Taguchi heated semi-conductor type having a semi-conductor element 13 located adjacent to a heating element 14. The gas detector 12 may be selected from any one of a number of commercially available gas detectors and one desirable detector is marketed by Figaro Engineering, Inc. of Osaka, Japan under the model designation TGS#812. The semi-conductive portion 13 and the heater 14 are mutually connected to a power input lead 15 providing a predetermined substantially constant voltage as supplied by a voltage regulator 17. A connector 18 is formed to be removably connected to a vehicle electrical source and is connected through a lead **18*a* to supply an energizing input to the regulator 17 to thereby provide the regulated energy to the power input lead 15. The connector 18 may be shaped for ready insertion into a cigarette lighter receptacle commonly found in many vehicles such as in automobiles, air craft, boats and the like. Alternatively, the connector 18** could be in other forms for ready connection to the vehicle energy source.

A signaling device 19 such as a light emitting diode (LED) is connected to the power input 15 through a resistor 20 while its cathode circuit is connected to a system neutral 21. The LED 19 provides a visual indication when the power input 15 is energized by the electrical connection of connector 18 to the vehicle electrical source.

For satisfactory operation, the gas sensor 12 must be heated to a predetermined temperature since the resistance at the electrode 13 is very small when at room temperature. Generally, it takes two to three minutes for the heating element 14, when initially energized through electrical energy supplied to the power input 15, to increase the temperature of the sensor 12 to a stabilized level for maximum sensitivity. When a contaminating gas such as carbon monoxide is sensed, the resistance at the electrode 13 is significantly reduced to thereby increase the current flow through the sensor 12.

A comparator 22 has its inverting input 23 connected to the electrode 13 of sensor 12 through a resistor 16 and to the system neutral 21 through a resistor 24. A non-inverting input 25 of comparator 22 is connected to a voltage dividing circuit 26 and specifically to a tap 27 of a variable resistor 28 provided by such voltage dividing circuit. The resistor 28 is connected to the power input 15 through a resistor 29 and a terminal **30*a* and is connected to the system neutral 21 through a terminal 30*b* and a resistor 31. The output tap 27 is manually adjustable to provide a predetermined magnitude reference voltage to the non-inverting input 25 of comparator 22. During normal operation following warm-up, the sensing of a predetermined high level of contaminated gas such as carbon monoxide by sensor 12 will provide an increased voltage level at the inverting input 23 which is sufficient to transfer an output 32 of comparator 22 from a high voltage to a lower voltage which is significantly less than the voltage level at the power input 15. The output circuit 32 of comparator 22 is connected to the power input 15 through a signaling device 33 which may constitute a horn or other device for issuing an audible sound. Thus when the output 32 of comparator 22 transfers from a high to a low voltage, a conducting path is provided through the signaling device 33 to provide an audible alarm indicating a high predetermined magnitude of contaminated gas as sensed by the sensor 12**.

A diode 34 provides a latching circuit and includes an anode which is connected to the non-inverting input 25 and a cathode circuit which is connected to the output circuit 32 of comparator 22. Thus when the output 32 transfers from a high voltage level to a low voltage level in response to a sensed high level of contamination at sensor 12, the diode 34 no longer is reverse biased and the voltage level at input 25 is significantly reduced to a very low voltage level to maintain the comparator 22 in a state to continually provide the second condition at output 32 to continually sound the alarm 33 irrespective of any changes of gas contamination at the sensor 12.

A second comparator 35 has a non-inverting input 36 connected to terminal **30*b* to receive a second predetermined magnitude reference voltage which is different than the reference voltage provided by tap 27. An inverting input 37 of comparator 35 is connected to the electrode 13 of sensor 12 through the resistor 16 and to resistor 24. An output circuit 38 of comparator 35 is connected to the power input 15 through a signaling device 39 such as a light emitting diode (LED) and a resistor 40. When the contaminated gas sensed at sensor 12 reaches a second predetermined magnitude which is less than the first predetermined magnitude, the voltage at the non-inverting input 37 is at such a magnitude to transfer the output 38 of comparator 35 from a high voltage level to a low voltage level to permit conduction from the power input 15 through resistor 40 and LED 39** to provide a visual signal indicating a low level of contamination.

An enable circuit 41 includes a timing circuit 42 coupled to a third comparator 43 and a fourth comparator 44. The timing circuit includes a serially connected resistor 45 and capacitor 46 which are coupled between the power input 15 and the system neutral 21. When power is initially provided to the power input 15, the capacitor 46 begins charging at a time constant established by the values of resistor 45 and capacitor 46. A junction 47 between resistor 45 and capacitor 46 is supplied to an inverting input 48 of comparator 43 while a non-inverting input 49 is connected to terminal 30 to supply a pre-established reference voltage thereto. After a predetermined time delay following the initiation of energy to the power input 15, the capacitor 46 is charged to a level which is sufficient for transferring an output 50 of comparator 43 from a high voltage level to a low voltage level indicating that sufficient time has elapsed to permit the heater 14 to increase the temperature at the electrodes 13 to a sufficient level for a proper gas monitoring operation. A signaling device 51 such as a light emitting diode (LED) is connected to the power input 15 through a resistor 52 while the cathode circuit of such LED 51 is connected to the output 50. Thus when comparator 43 transfers its output 50 from a high voltage level to a low voltage level following the predetermined time delay, a conducting circuit will be provided from the power input 15 through resistor 52 and LED 51 to the output 50 and provide a visual indication that the warm-up time period has elapsed. An inverting input 53 of the comparator 44 is connected to the output 50 of comparator 53 while a non-inverting input 54 is connected to the power input 15 to provide a preestablished voltage level thereat. When the output 50 of comparator 43 transfers to a low voltage level, an output 55 of comparator 44 will transfer from a low voltage level to a high voltage level to thereby provide a disable signal to the inverting inputs 23 and 37 of the comparators 22 and 35, respectively. In such manner, the comparators 43 and 44 respond to the timing circuit 42 to provide a disable input to both of the comparators 22 and 35 to thereby disable the signaling devices 33 and 39 during the period of time that heater 14 is increasing its temperature output to a pre-established level to provide stability for the electrode 13. Failure to provide such disable sequence may result in a fictitious or erroneous operation of comparators 22 and 35 thereby resulting in erroneous signaling alarms provided by devices 33 and 39.

Once the gas detector 11 senses the high predetermined level of contaminated gas concentration thereby transferring the comparator 22 from its first condition to its second condition, the alarm 33 will continue to be activated through the operation of the latching circuit 34 to require an operator to take some physical step to rectify the condition and reset the circuit. Such resetting is accomplished by removing the connector 18 from the vehicle electrical source to de-energize the power input 15. With power disconnected from the input 15, both of the alarms 33 and 39 are de-energized as well as the signaling devices 19 and 51. The capacitor 46 is permitted to discharge to the system neutral 21 through a discharge circuit including a diode 56 and the voltage divider circuit 26, the heater 14, the LED 19 and resistor 20, etc. When the removable connector 18 is reinserted to engage vehicle electrical power, a predetermined delay in the sensing operation is again provided by the enable circuit 41 through the timing circuit 42. If a sensed high contaminated gas concentration still exists following the predetermined time period provided by the timing circuit 42, the alarm 33 will again be activated and latched so as to require further manual action by an operator to de-energize such alarm.

The comparator 35 and the associated signaling device 39 provides an early warning when a lower intermediate gas concentration is sensed to permit an operator to take early corrective action before it is necessary to activate the alarm 33 indicating a high level of gas contamination.

The use of the comparator 22 with a plurality of inputs permits a simplicity of construction while still providing a reliable operation. The gas detector may be packaged in a small assembly which may be readily carried in a pocket or mounted conveniently at instrument panels in vehicles. Further, the gas detector may be further readily repaired if necessary. Visual indications are provided to signal the proper supply of input power to the detector circuitry and also to signal the elapse of the warm-up period when the detector is enabled for a sensing operation.

Various modes of carrying out the invention are contemplated as being within the scope of the following claims, particularly pointing out and distinctly claiming the subject matter which is regarded as the invention.

I claim:

1. A gas detector, comprising an alarm, electrical power means connected to said alarm and to be selectively energized to operate the alarm for detector operation, a gas sensor including a sensing portion to be exposed to the surrounding environment to detect concentrations of carbon monoxide gas and a heater having an input connected to said power means to provide heat to said sensing portion, an enable circuit including timing means connected to said power means to provide a timed output in response to a predetermined time delay following the initial energization of said heater, a comparator having an output means and a separate multiple signal input means and having means to compare the input signals and establish an output at said output means selectively transferable between a first condition to indicate a gas concentration below a predetermined magnitude and a second condition to activate said electrical power means to indicate a gas concentration above said predetermined magnitude and said input means connected to receive a first input from said enable circuit to disable said comparator for said predetermined time delay to prevent operation of said alarm while said heater is initially energized and a second input from said gas detector to continuously monitor the carbon monoxide concentration to provide said second condition in response to the sensing of at least said predetermined magnitude gas concentration and a third input from said comparator output to latch said comparator to continuously activate said alarm in response to the occurrence of said second condition, and resetting means connected to selectively de-energize said electrical power means to de-activate said alarm and condition said gas detector for continued gas monitoring.

2. The gas detector of claim 1, wherein said comparator is connected to a voltage divider to receive a fourth input to provide a predetermined magnitude reference voltage.

3. The gas detector of claim 1, and including a second comparator having an output selectively transferrable between a first condition to indicate a gas concentration below a second predetermined magnitude different than said first magnitude and a second condition to activate a second alarm to indicate a gas concentration above said second predetermined magnitude and input means connected to receive said first input from said enable circuit to disable said second comparator for said predetermined time delay and connected to said gas detector to continuously monitor the carbon monoxide concentration.

4. The gas detector of claim 3, wherein said enable circuit includes said timing means includes timing circuit connected to provide a timed output in response to the initial energization of said power means, a third comparator to operate in response to said timed output to transfer from a first condition to a second condition, and a fourth comparator to operate in response to said second condition of said third comparator to provide said first input to said first and second comparators.

5. A portable gas detector for a vehicle having an electrical source, comprising a connector to be removably connected to the vehicle electrical source, a voltage regulator connected to said connector to provide a power input having a highly regulated voltage in response to said removable connector being electrically connected to said vehicle source, a first signaling device connected to said power input to provide a first visual signal indicating the existence of electrical energy at said power input, a gas sensor including a semi-conductive portion to be exposed to the surrounding environment to detect concentrations of carbon monoxide gas and having an input connected to said power input and a heating coil having an input connected to said power input and located adjacent to said semi-conductive portion to be energized in response to the energization of said power input to vary the temperature of said semi-conductive portion to control the sensitivity of said gas sensor, a voltage divider circuit connected to said power input and including a plurality of series connected resistors and a first output connection including a potentiometer with a selectively variable tap providing a first predetermined magnitude reference voltage and a second output connection providing a second predetermined magnitude reference voltage more than said first magnitude, a first voltage comparator having a first input connected to said first voltage divider output to receive said first magnitude reference voltage and a second input connected to said semi-conductive portion through a resistor and an output selectively transferrable between a first condition in response to the sensed concentration of carbon monoxide being below a first predetermined magnitude and a second condition in response to the sensed carbon monoxide concentration being above said first predetermined magnitude, a second signaling device connecting said first comparator output to said power input and energized to provide a second audible signal in response to said second condition of said first comparator indicating a carbon monoxide concentration above the first predetermined magnitude, a second voltage comparator having a first input connected to said second voltage divider output to receive said second magnitude reference voltage and a second input connected to said semi-conductive portion through said resistor and an output selectively transferrable between a first condition in response to the sensed carbon monoxide concentration being below a second predetermined magnitude less than said first magnitude and a second condition in response to the sensed carbon monoxide concentration being above said second predetermined magnitude, a third signaling device connecting said second comparator output to said power input and energized to provide a third visual signal different than said second signal in response to said second condition of said second comparator indicating a carbon monoxide concentration above the second predetermined magnitude, an enable circuit including a timing circuit having a series connected resistor and capacitor connected between said power input and a system neutral and a timed output connected at a junction between said resistor and capacitor and a third voltage comparator having a first input connected to said voltage divider and a second input connected to said timed output and an output selectively transferrable between a first condition responsive to the initial de-energization of said power input to a second condition responsive to a predetermined magnitude time delay following the initial supply of electrical energy to said power input and a fourth voltage comparator having a first input connected to said power input and a second input connected to said third comparator output and an output selectively transferrable between a first condition responsive to said third comparator first condition and a second condition responsive to said third comparator second condition, said fourth comparator output connected to said second inputs of said first and second comparators to disable said first and second comparators and said second and third signaling devices for said predetermined magnitude time delay to permit a timed energization of said heating coil before enabling said first and second comparators and said second and third signaling devices to avoid erroneous second and third signals, a fourth signaling device connecting said third comparator output to said power input and energized to provide a fourth visual signal in response to said second condition of said third comparator following said predetermined time delay, a latch connected between said first input and said output of said first comparator and operative to transfer said first magnitude reference voltage to a third magnitude reference voltage different than said first and second magnitude reference voltages to maintain said second condition at said first comparator output to maintain said second signal irrespective of the magnitude of carbon monoxide concentration until said power input is de-energized, and a circuit electrically connecting said capacitor to a system neutral to de-energize said capacitor in response to the de-energization of said power input.

6. A gas detector, comprising an alarm, electrical power means connected to said alarm and to be selectively energized to operate the alarm for detector operation, a gas sensor including a sensing portion to be exposed to the surrounding environment to detect concentrations of carbon monoxide gas and a heater having an input connected to said power means to provide a heat to said sensing portion, an enable circuit including timing means connected to said power means to provide a timed output in response to a predetermined time delay following the initial energization of said heater, a comparator having an output selectively transferable between a first condition to indicate a gas concentration below a predetermined magnitude and a second condition connected to activate said alarm to indicate a gas concentration above said predetermined magnitude and input means connected to receive a first input from said enable circuit to disable said comparator for said predetermined time delay to prevent operation of said alarm while said heater is initially energized and a second input from said gas detector to continuously monitor the carbon monoxide concentration to provide said second condition in response to the sensing of said predetermined magnitude gas concentration, and said timing means including a timing circuit connected to provide a timed output in response to the initial energization of said power means, a second comparator connected to said timing circuit to operate in response to said time output to transfer from a first condition to a second condition, and a third comparator connected to said second comparator to operate in response to said second condition of said second comparator to provide said first input to said first comparator.

* * * * *